US011459807B2

(12) United States Patent
Sato

(10) Patent No.: US 11,459,807 B2
(45) Date of Patent: Oct. 4, 2022

(54) RETAINING DEVICE

(71) Applicant: Sugatsune Kogyo Co., Ltd., Tokyo (JP)

(72) Inventor: Genichi Sato, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 879 days.

(21) Appl. No.: 16/264,202

(22) Filed: Jan. 31, 2019

(65) Prior Publication Data

US 2019/0234125 A1 Aug. 1, 2019

(30) Foreign Application Priority Data

Jan. 31, 2018 (JP) ..... JP2018-015330

(51) Int. Cl.
*A47B 88/473* (2017.01)
*E05B 15/02* (2006.01)
(Continued)

(52) U.S. Cl.
CPC ..... *E05C 19/063* (2013.01); *A47B 88/473* (2017.01); *A47B 88/477* (2017.01);
(Continued)

(58) Field of Classification Search
CPC ..... E05C 19/063; E05C 19/00; E05C 19/06; A47B 88/473; A47B 88/477; A47B 88/90;
(Continued)

(56) References Cited

U.S. PATENT DOCUMENTS 10,130,146 B2 * 11/2018 Kolasa ..... A44B 11/266
10,408,248 B1 * 9/2019 Safry ..... F16B 5/0628
(Continued)

FOREIGN PATENT DOCUMENTS

GB 2040348 A 1/1980
JP 5938370 U 3/1984
(Continued)

OTHER PUBLICATIONS

Chinese Office Action dated Jul. 1, 2020, issued in Chinese Application No. 201910035949.8, 13 pages with translation.
(Continued)

*Primary Examiner* — Kristina R Fulton
*Assistant Examiner* — Thomas L Neubauer
(74) *Attorney, Agent, or Firm* — Masuvalley & Partners; Peter Martinez

(57) ABSTRACT

PROBLEM: To provide a retaining device for which the magnitude of resistance when an engaging protrusion moves between elastic pieces can be adjusted.
SOLUTION: The retaining device 4 is provided with: a receiving member 5 that is attached to a main body 1, and an engagement member 6 that is attached to a movable body 2. The receiving member 5 has: a base part 10 attached to the main body 1, a first elastic piece 11 supported by the base part 10, and a second elastic piece 12 supported by the base part 10. The engagement member 6 has an engaging protrusion 8 that passes between the first elastic piece 11 and the second elastic piece 12 and is retained at a retaining position P. An interval between the first elastic piece 11 and the second elastic piece 12 becomes narrower than the engaging protrusion 8 at a more forward side than the retaining position P. The first elastic piece 11 bends more easily than the second elastic piece 12 at a more forward side than the retaining position P.

11 Claims, 11 Drawing Sheets

(51) Int. Cl.

| | |
|---|---|
| ***E05B 63/06*** | (2006.01) |
| ***E05C 19/06*** | (2006.01) |
| ***E05F 5/08*** | (2006.01) |
| ***E05B 65/46*** | (2017.01) |
| ***E05F 5/00*** | (2017.01) |
| ***A47B 88/477*** | (2017.01) |

(52) U.S. Cl.
CPC ..... *E05B 15/022* (2013.01); *E05B 63/06* (2013.01); *E05B 65/46* (2013.01); *E05F 5/003* (2013.01); *E05F 5/08* (2013.01); *E05Y 2900/20* (2013.01)

(58) Field of Classification Search
CPC ..... E05B 15/022; E05B 63/06; E05B 65/46; E05B 65/08; E05B 65/44; E05F 5/003; E05F 5/08; E05Y 2900/20; E05Y 2201/218; E05Y 2201/418; E05Y 2201/48; E05Y 2600/12; E05Y 2900/132; F16B 2/22; E05D 13/04
See application file for complete search history.

(56) References Cited

U.S. PATENT DOCUMENTS

| | | | | |
|---|---|---|---|---|
| 2011/0314644 | A1* | 12/2011 | Wei | F16B 21/073 24/343 |
| 2014/0090509 | A1* | 4/2014 | Lochet | F16B 21/078 74/491 |
| 2019/0234125 | A1 | 8/2019 | Sato et al. | |

FOREIGN PATENT DOCUMENTS

| | | | |
|---|---|---|---|
| JP | 62101785 | A | 5/1987 |
| JP | H04-110548 | U | 9/1992 |

OTHER PUBLICATIONS

Office Action dated Jul. 2, 2019, issued in corresponding England Patent Application No. GB1901250.9, total 6 pages.

* cited by examiner

RETAINING DEVICE

RELATED APPLICATIONS

This application claims priority to Japanese Patent Application No. JP2018-015330 filed Jan. 31, 2018, which is incorporated herein by reference in its entirety.

TECHNICAL FIELD

The present invention relates to a retaining device for retaining a drawer, a sliding door, and a door, etc. at a prescribed position.

BACKGROUND

As this type of retaining device, patent document 1 discloses a retaining device provided with: a receiving member that is attached to a main body, and an engagement member that is attached to a drawer. When the drawer is closed with respect to the main body, the engagement member is retained by the receiving member, and the drawer is retained at the closed position.

The receiving member is provided with a total of four elastic pieces. An engaging protrusion that is retained by the four elastic pieces is provided at the engagement member. A center of the four elastic pieces is the retaining position for the engaging protrusion. A pair of top and bottom elastic pieces is provided further to the left side than the retaining position. This pair of elastic pieces at the left side can bend so that the interval therebetween becomes narrower than the engaging protrusion. Likewise, a pair of top and bottom elastic pieces is provided further to the right side than the retaining position. This pair of elastic pieces at the right side can also bend so that the interval therebetween becomes narrower than the engaging protrusion.

The drawer can be pulled out from the front of the main body and from the rear of the main body. When a drawer located in a forward opened position is to be closed, the engaging protrusion passes between the left side pair of top and bottom elastic pieces, elastically deforms the pair of elastic pieces so that the interval between the two pieces opens, and reaches the retaining position. When a drawer located in the rearward opened position is to be closed, the engaging protrusion passes between the right side pair of elastic pieces, elastically deforms the pair of elastic pieces so that the interval between the two pieces opens, and reaches the retaining position. Once the engaging protrusion has reached the retaining position, the engaging protrusion is retained at that position by the four elastic pieces.

PRIOR ART DOCUMENTS

Patent Documents

Patent Document 1: Japanese Unexamined Utility Model Application Publication No. H04-110548

SUMMARY OF INVENTION

Problem to be Solved by the Invention

However, a problem with the retaining device described by patent document 1 is that it is difficult to adjust the magnitude of resistance when the engaging protrusion passes between the elastic pieces, and/or the magnitude of force when the engaging protrusion is retained at the retaining position.

Therefore, an object of the present invention is to provide a retaining device that can adjust the magnitude of resistance when the engaging protrusion passes between the elastic pieces, and/or the magnitude of force when the engaging protrusion is retained at the retaining position.

Means for Solving the Problem

In order to solve the abovementioned problem, one aspect the present invention is a retaining device provided with: a receiving member attached to one of either a main body or a movable body; and an engagement member attached to the other of the main body or the movable body; wherein the receiving member has: a base part attached to the one; a first elastic piece supported by the base part; and a second elastic piece supported by the base part; the engagement member has an engaging protrusion that passes between the first elastic piece and the second elastic piece and is retained at a retaining position; an interval between the first elastic piece and the second elastic piece is narrower than the engaging protrusion further to one side than the retaining position in a relative movement direction of the engaging protrusion; and further to the one side than the retaining position in the relative movement direction of the engaging protrusion, one of the first elastic piece and the second elastic piece bends more easily than the other.

Effect of the Invention

According to the present invention, by adjusting the position of the engaging protrusion, the magnitude of resistance when the engaging protrusion passes between the first elastic piece and the second elastic piece, and/or the magnitude of force when the engaging protrusion is retained at the retaining position can be adjusted. In other words, if the engaging protrusion is disposed near one of either the first elastic piece or the second elastic piece, the resistance and force can be made smaller, and if the engaging protrusion is disposed near the other of the first elastic piece or the second elastic piece, the resistance and force can be made larger.

BRIEF DESCRIPTION OF THE DRAWINGS

(FIG. 1A illustrates the closed position of the drawer, and FIG. 1B illustrates the opened position of the drawer).

(FIG. 2A illustrates the closed position of the drawer, FIG. 2B illustrates the forward opened position, and FIG. 2C illustrates the rearward opened position).

FIG. 6A illustrates an upper end position of a shaft, FIG. 6B illustrates an intermediate position of the shaft, and FIG. 6C illustrates a lower end position of the shaft).

FIG. 8A illustrates a case in which the short axis of the ellipse is oriented vertically, and FIG. 8B illustrates a case in which the long axis of the ellipse is oriented vertically).

(FIG. 13A illustrates a left side closed position of a sliding door, FIG. 13B illustrates the center closed position of the sliding door, and FIG. 13C illustrates the right side closed position of the sliding door).

(FIG. 14A illustrates the rear side opened position of the door, FIG. 14B illustrates the closed position of the door, and FIG. 14C illustrates the front side opened position of the door).

DESCRIPTION OF THE PREFERRED EMBODIMENT

Embodiments of the retaining device of the present invention are described in detail below on the basis of the attached drawings. However, the retaining device of the present invention can be embodied in various forms, and is not limited to the embodiments described in the present specification. The present embodiments are provided through ample disclosure in the specification with the intention of facilitating sufficient understanding of the scope of the invention by a person skilled in the art.

First Embodiment

Figure 1A:
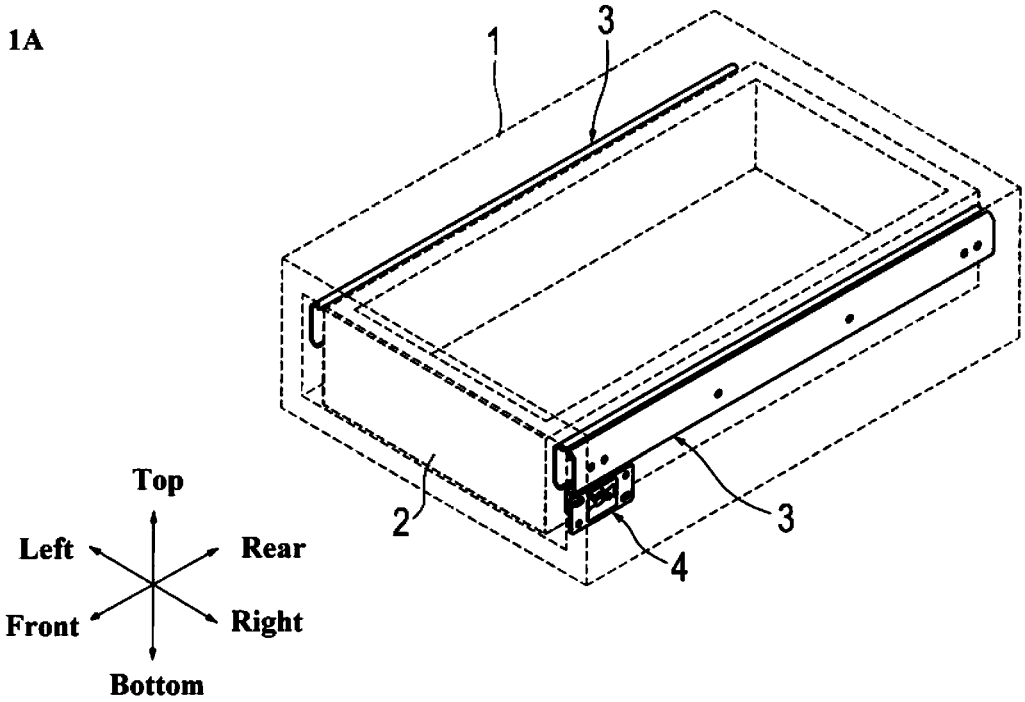
FIG. 1A-FIG. 1B are perspective view of a drawer system in which a retaining device of a first embodiment of the present invention is incorporated

FIG. 1A-FIG. 2C illustrate a drawer system in which the retaining device of a first embodiment of the present invention is incorporated. Reference numeral 1 is a main body, 2 is a drawer, 3 is a slide rail, and 4 is the retaining device. Note that hereinafter, for convenience of the description, the configuration of the drawer system is described using directions that are based on viewing the drawer 2 from the front, namely, each of the directions of front, rear, left, right, top and bottom as shown in FIG. 1A. The arrangement of each configuration of the drawer system is of course not limited to this type of arrangement.

Figure 1B:
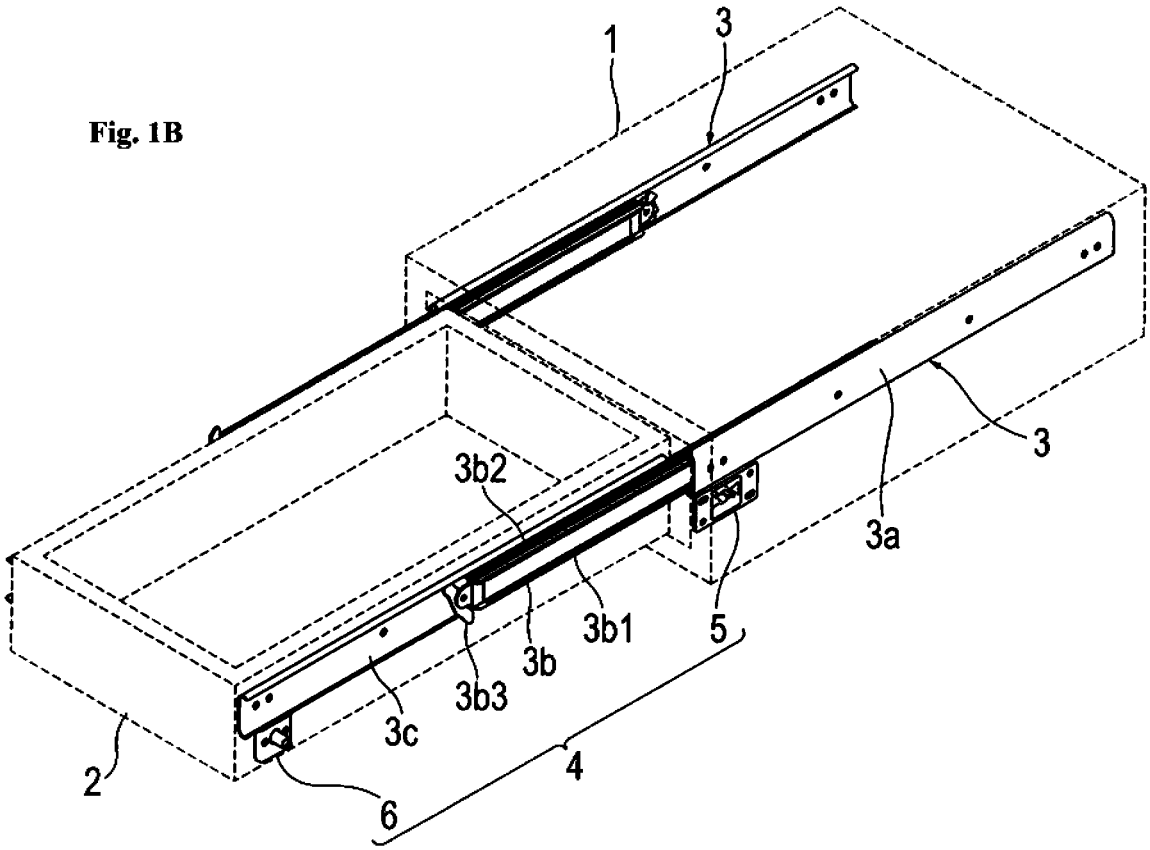
Figures 2A, 2B, 2C:
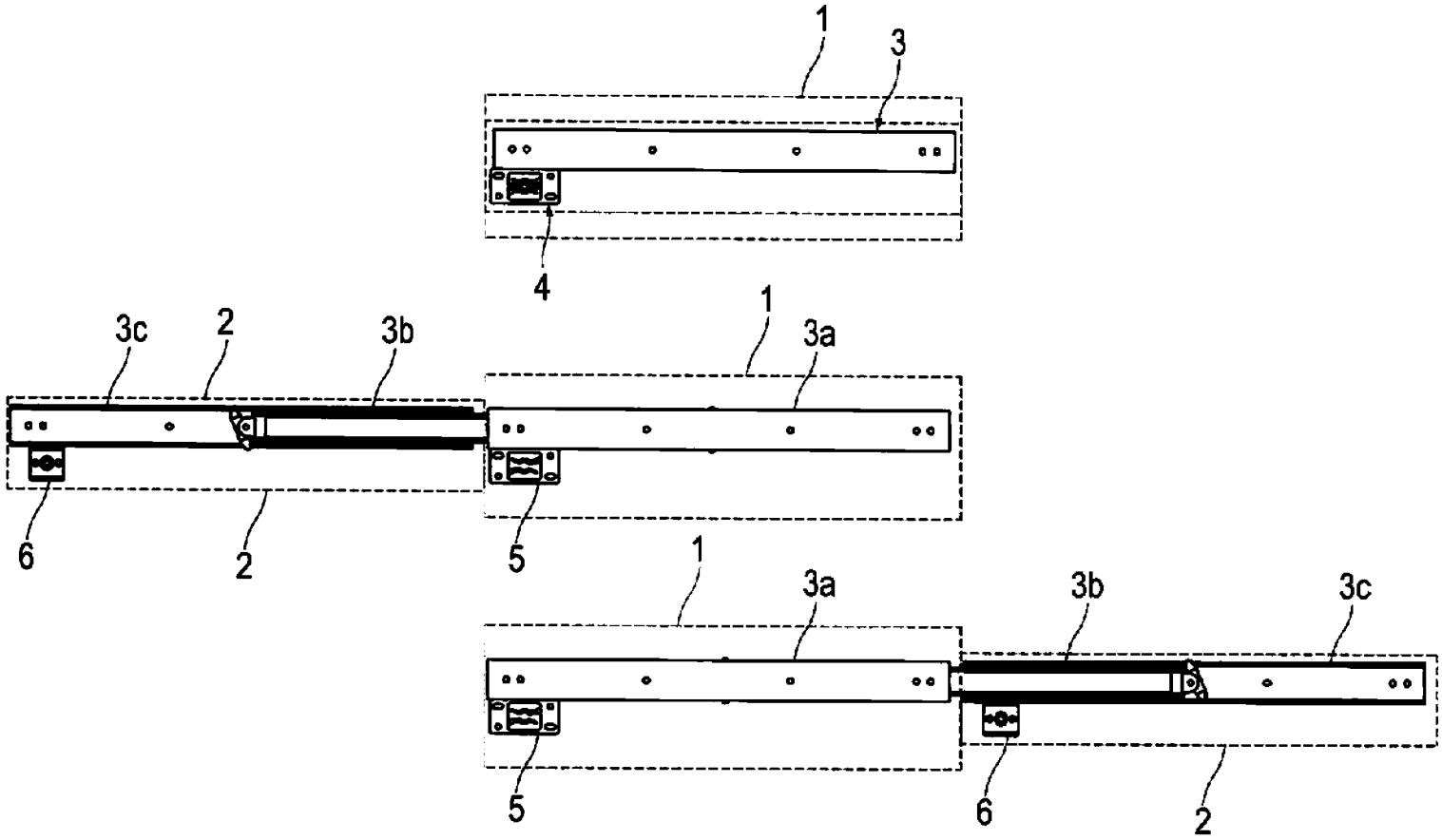
FIG. 2A-FIG. 2C are side view of the drawer system

FIG. 1A illustrates the closed position of the drawer 2, and FIG. 1B illustrates the opened position. FIG. 2A illustrates the closed position of the drawer 2, FIG. 2B illustrates the forward opened position, and FIG. 2C illustrates the rearward opened position. The drawer 2 can move from the closed position to the forward opened position and to the rearward opened position.

As illustrated in FIG. 1A-FIG. 1B, a pair of left and right slide rails 3 is provided at the left and right side surfaces of the drawer 2. The movement of the drawer 2 in the front and rear directions is guided by the slide rails 3.

Each of the slide rails 3 is provided with an outer rail 3*a* that is attached to an inner surface of the main body 1, an inner rail 3*c* that is attached to a side surface of the drawer 2, and an intermediate rail 3*b* that is slidably fitted into the outer rail 3*a* and the inner rail 3*c*. A plurality of balls, which are not illustrated, is interposed between the outer rail 3*a* and the intermediate rail 3*b*. The balls are rotatably retained by a retainer, which is not illustrated. A plurality of balls, which are not illustrated, is also interposed between the intermediate rail 3*b* and the inner rail 3*c*. These balls are also rotatably retained by a retainer, which is not illustrated.

The outer rail 3*a* has a cross section that is in the shape of a C. Both end parts in the vertical direction of the outer rail 3*a* are rounded into an outward facing arc shape. The balls roll on the inner surface of both end parts of the outer rail 3*a*. The inner rail 3*c* also has a cross section that is in the shape of a C, and both end parts in the vertical direction are rounded into an outward facing arc shape. Balls roll on the inner surface of both end parts of the inner rail 3*c*.

The intermediate rail 3*b* is obtained by joining an outer rail side substrate 3*b*1 and an inner rail side substrate 3*b*2 with the rear surfaces aligned. The outer rail side substrate 3*b*1 has a cross section in the shape of a U. Both end parts in the vertical direction of the outer rail side substrate 3*b*1 are rounded into an inward facing arc shape, and balls roll on the outer surface of both end parts of the outer rail side substrate 3*b*1. The inner rail side substrate 3*b*2 also has a cross section in the shape of a U. Both end parts in the vertical direction of the inner rail side substrate 3*b*2 are rounded into an inward facing arc shape, and balls roll on the outer surface of both end parts of the inner rail side substrate 3*b*2.

A sequential mechanism 3*b*3 is incorporated into the intermediate rail 3*b*. The sequential mechanism 3*b*3 ensures that the intermediate rail 3*b* and the inner rail 3*c* slide with good sequence. When the drawer 2 is to be opened, first, the intermediate rail 3*b* slides, and next, the inner rail 3*c* slides. When the drawer 2 is to be closed, first, the inner rail 3*c* slides, and next, the intermediate rail 3*b* slides.

As illustrated in FIG. 1A and FIG. 2A, when the drawer 2 is moved to the closed position, the drawer 2 is retained at the closed position by the retaining device 4. The retaining device 4 is provided with a receiving member 5 that is attached to the inner surface of the main body 1, and an engagement member 6 that is attached to a side surface of the drawer 2. The receiving member 5 is disposed so as to travel along the outer rail 3*a*. The engagement member 6 is disposed so as to travel along the inner rail 3*c*.

Figure 3:
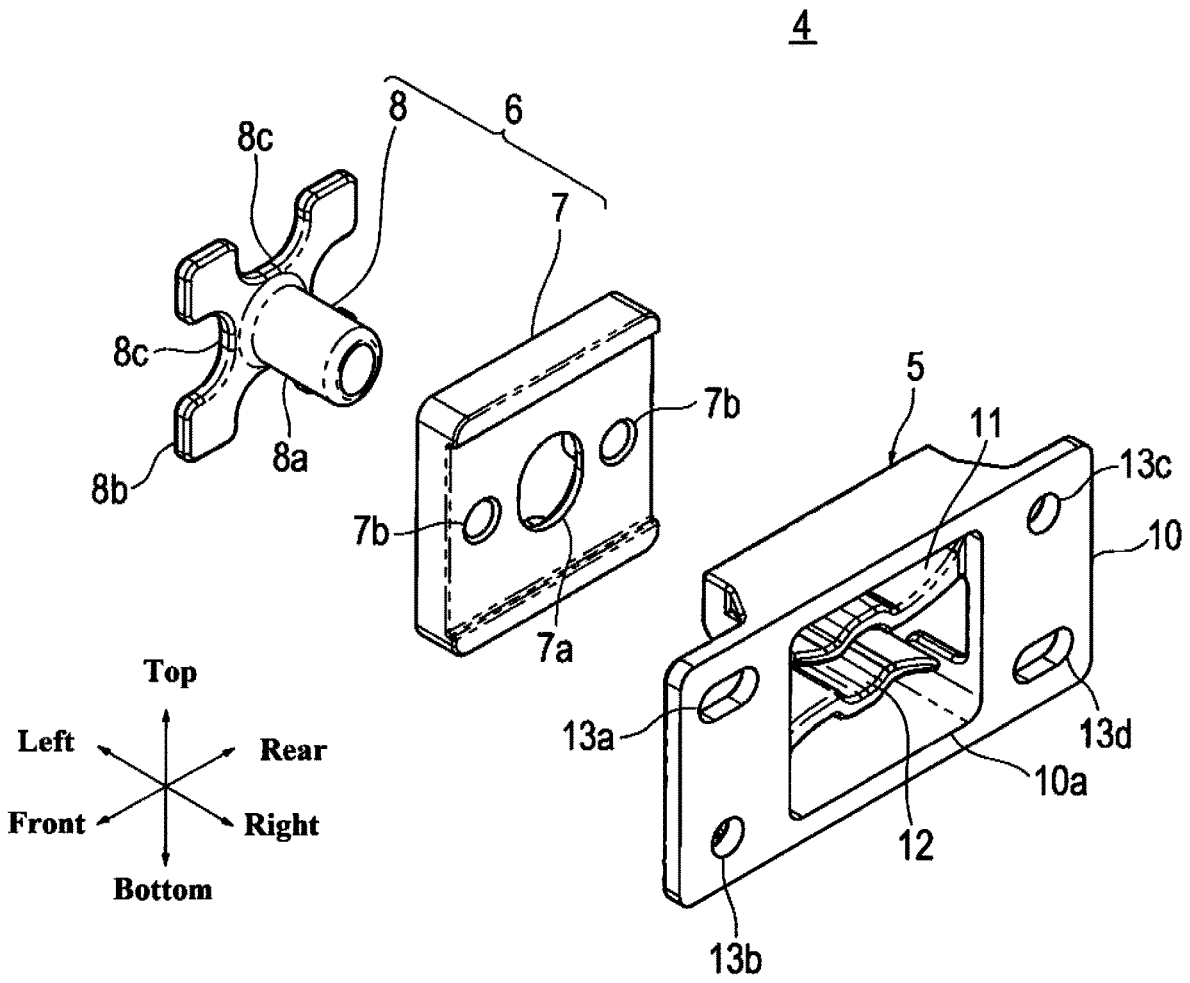
FIG. 3 is an exploded perspective view of the retaining device of the present embodiment (exploded perspective view as viewed from the main body side).
Figure 4:
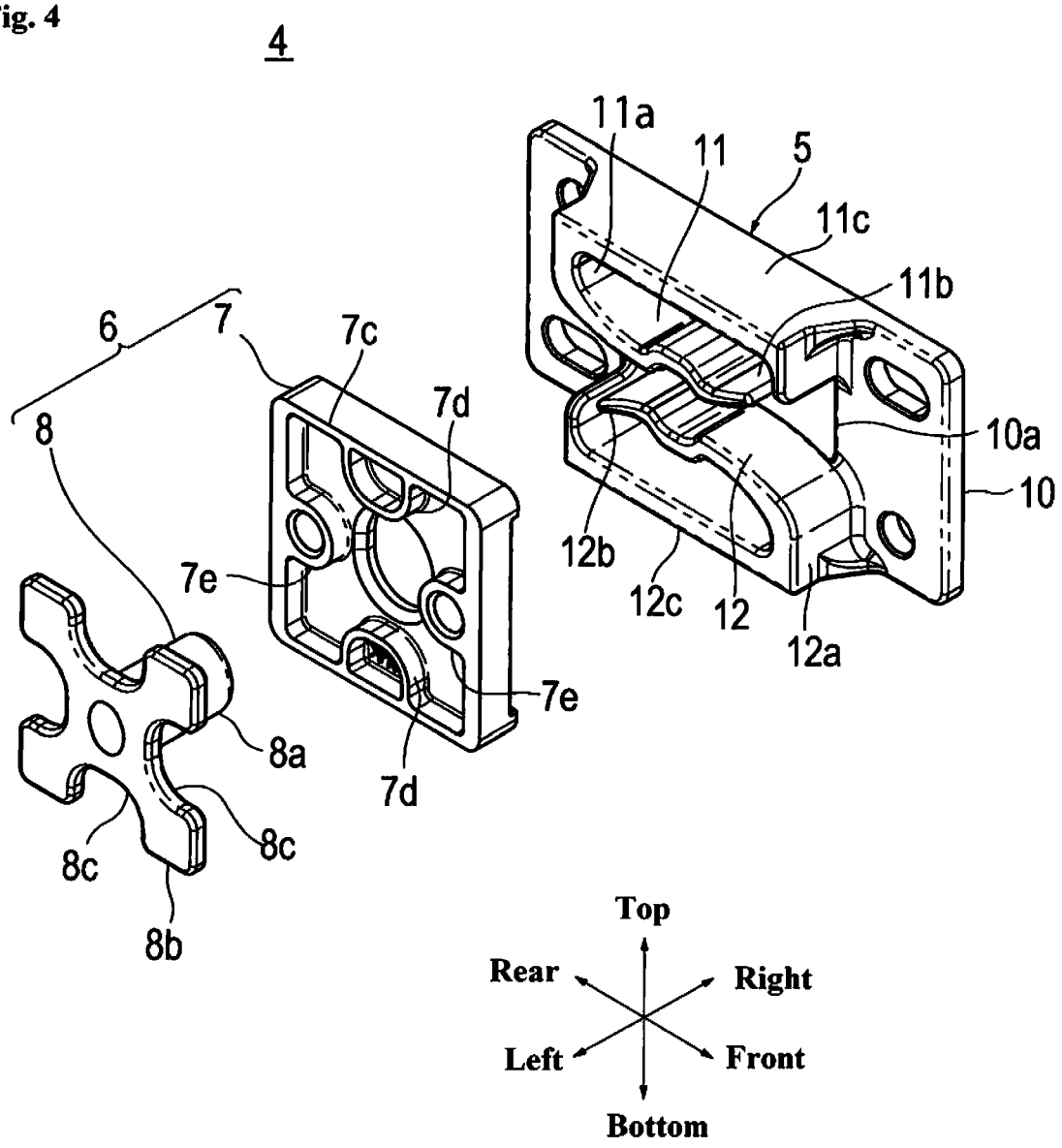
FIG. 4 is an exploded perspective view of the retaining device of the present embodiment (exploded perspective view as viewed from the drawer side).

FIG. 3 and FIG. 4 are exploded perspective views of the retaining device 4. FIG. 3 is an exploded perspective view of the retaining device 4 as viewed from the main body 1 side, and FIG. 4 is an exploded perspective view of the retaining device 4 as viewed from the drawer 2 side. Reference numeral 5 is the receiving member, 6 is the engagement member, 10 is a base part of the receiving member 5, 11 is a first elastic piece, and 12 is a second elastic piece. Reference numeral 7 is a base part of the engagement member 6, and 8 is an engaging protrusion of the engagement member 6.

The base part 10 of the receiving member 5 is a quadrilateral plate shape. A quadrilateral opening 10*a* is formed in the center of the base part 10. Attachment holes 13*a* to 13*d* for attaching the receiving member 5 to the main body 1 are formed in the four corners of the base part 10. Two attachment holes 13*a*, 13*d* that are positioned at opposite corners are formed as oblong holes so that the attachment position of the receiving member 5 can be adjusted.

As illustrated in FIG. 4, the first elastic piece 11 is cantilever-supported at the top part of the base part 10. A rear end part of the first elastic piece 11 is a fixed end 11*a*, and a front end part of the first elastic piece 11 is a free end 11*b*. The first elastic piece 11 is exposed inside the opening 10*a* (see FIG. 3). A rib 11*c* that runs along an upper edge of the opening 10*a* is integrally formed with the fixed end 11*a* of the first elastic piece 11.

The second elastic piece 12 is cantilever-supported at the bottom part of the base part 10. A front end part of the second elastic piece 12 is a fixed end 12*a*, and a rear end part of the second elastic piece 12 is a free end 12*b*. The second elastic piece 12 is also exposed inside the opening 10*a* (see FIG. 3), and a rib 12*c* that runs along a lower edge of the opening 10*a* is integrally formed with the fixed end 12*a* of the second elastic piece 12.

Figure 5:
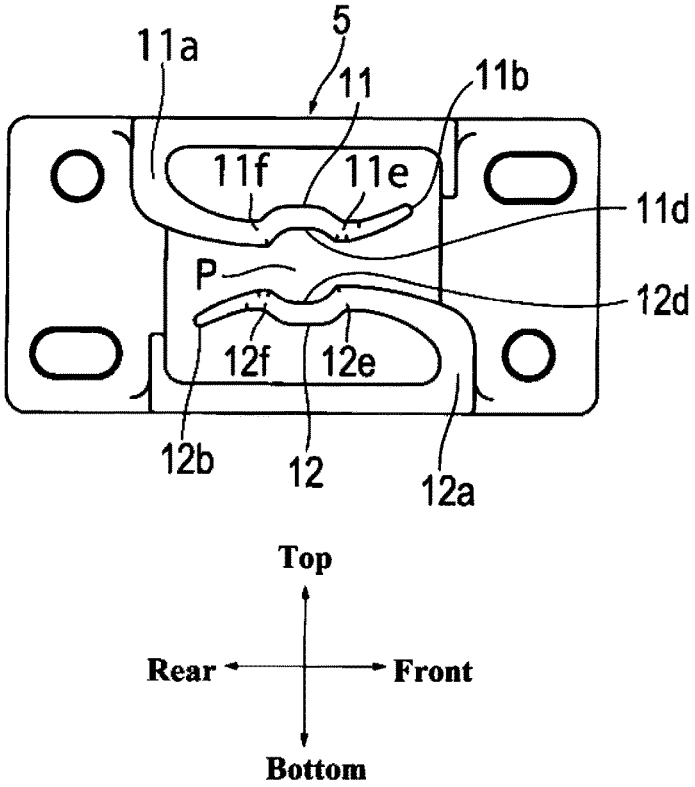
FIG. 5 is a back view of the receiving member of the present embodiment (back view as viewed from the drawer side).

FIG. 5 illustrates a back view of the receiving member 5 as viewed from the drawer 2 side. The thickness of the first elastic piece 11 gradually becomes thinner moving from the fixed end 11*a* to the free end 11*b*. A recess 11*d* for retaining the engaging protrusion 8 is formed at a center part of the first elastic piece 11. The thickness of the second elastic piece 12 also gradually becomes thinner moving from the fixed end 12*a* towards the free end 12*b*. A recess 12*d* for retaining the engaging protrusion 8 is also formed at a center part of the second elastic piece 12. The positions of the recesses 11*d*, 12*d* are the retaining position P of the engaging protrusion 8.

At a further forward side than the retaining position P, the first elastic piece 11 and the second elastic piece 12 bend so that the interval between the first elastic piece 11 and the second elastic piece 12 becomes narrower than the engaging protrusion 8. Namely, the first elastic piece 11 and the second elastic piece 12 have bending sections 11*e*, 12*e* further forward than the retaining position P. The first elastic piece 11 and the second elastic piece 12 are inclined so that further forward than the bending sections 11*e*, 12*e*, the interval between the first elastic piece 11 and the second elastic piece 12 becomes wider moving forward.

Furthermore, at a further rearward side than the retaining position P, the first elastic piece 11 and the second elastic piece 12 bend so that the interval between the first elastic piece 11 and the second elastic piece 12 becomes narrower than the engaging protrusion 8. That is, the first elastic piece 11 and the second elastic piece 12 respectively have bending sections 11*f*, 12*f* at a further rearward side than the retaining position P. At a further rearward side than the bending sections 11*f*, 12*f*, the first elastic piece 11 and the second elastic piece 12 are inclined so that the interval between the first elastic piece 11 and the second elastic piece 12 becomes wider moving rearward.

As illustrated in FIG. 3 and FIG. 4, the engagement member 6 has a base part 7 that is attached to the drawer 2, and an engaging protrusion 8 that is detachably inserted into the base part 7.

The base part 7 has a quadrilateral plate shape. A hole 7*a* into which the engaging protrusion 8 is inserted is formed in the center of the base part 7. Attachment holes 7*b* for attaching the base part 7 to the drawer 2 are also formed in the base part 7. As illustrated in FIG. 4, a quadrilateral frame-shaped projection 7*c* is formed at the rear surface of the base part 7. Semicircular projections 7*d*, 7*e* are formed at the inside of each side of the frame-shaped projection 7*c*.

As illustrated in FIG. 3, the engaging protrusion 8 is provided with a shaft 8*a*, and a projecting section 8*b* that is provided at an axial direction end part of the shaft 8*a*. The shaft 8*a* is hollow and has a cross section that is in the form of an ellipse. The projecting section 8*b* has a shape that is based on a quadrilateral and has a semicircular notch 8*c* formed in each side of the quadrilateral.

When the engaging protrusion 8 is inserted into the base part 7 of the engagement member 6, the shaft 8*a* enters the hole 7*a*, and the projecting section 8*b* is contained within the frame-shaped projection 7*c*. The frame-shaped projection 7*c*, semicircular projections 7*d*, 7*e*, and projecting section 8*b* are formed so that the engaging protrusion 8 can move in the vertical direction with respect to the base part 7, and cannot move in the left and right directions.

Figure 6A:
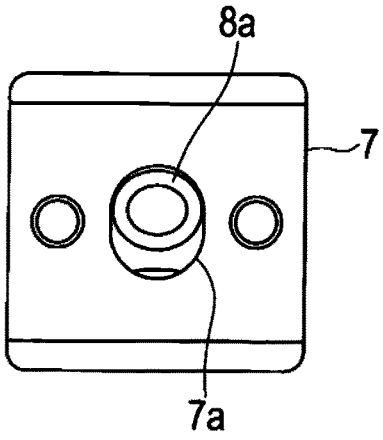
FIG. 6A-FIG. 6C are elevation view of the engagement member of the present embodiment (elevation view as viewed from the main body side.
Figure 6B:
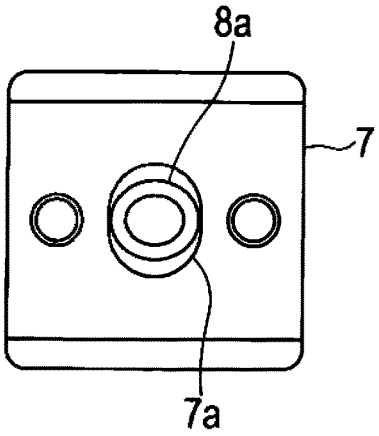
Figure 6C:
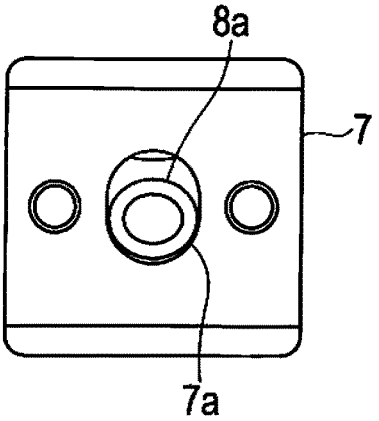

FIG. 6A illustrates an upper end position of the shaft 8*a*, FIG. 6B illustrates an intermediate position of the shaft 8*a*, and FIG. 6C illustrates a lower end position of the shaft 8*a*. As illustrated in FIG. 6A-FIG. 6C, the shaft 8*a* can move in the vertical direction between the upper end position and the lower end position.

As illustrated in FIG. 4, the projecting section 8*b* is formed so that even if the engaging protrusion 8 is rotated 90 degrees around the shaft 8*a*, the projecting section 8*b* can be contained within the frame-shaped projection 7*c*. The cross section of the shaft 8*a* is an ellipse shape, and therefore when the engaging protrusion 8 is rotated 90 degrees, the vertical direction length of the shaft 8*a* changes. As shown in FIG. 6B, when the short axis of the ellipse is oriented in the vertical direction, the vertical direction length of the shaft 8*a* becomes shorter, and as shown in FIG. 7, when the long axis of the ellipse is oriented in the vertical direction, the vertical direction length of the shaft 8*a* becomes longer.

Figure 7:
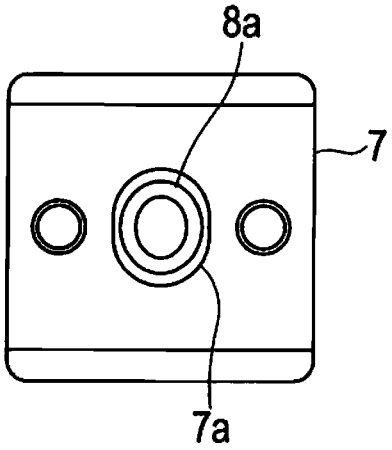
FIG. 7 is an elevation view of the engagement member of the present embodiment (for a case in which the long axis of an ellipse is oriented in the vertical direction).

Note that the frame-shaped projection 7*c*, semicircular projections 7*d*, 7*e*, and projecting section 8*b* are formed so that even when the long axis of the ellipse is oriented in the vertical direction as shown in FIG. 7, the shaft 8*a* can move in the vertical direction with respect to the base part 7, and cannot move in the left and right directions.

The operation of the retaining device 4 of the present embodiment is described below. As illustrated in FIG. 8, the engaging protrusion 8 moves forward and rearward between the first elastic piece 11 and the second elastic piece 12. When the engaging protrusion 8 moves from the front to the recesses 11*d*, 12*d*, or in other words, when the engaging protrusion reaches the retaining position P, the engaging protrusion 8 elastically deforms the first elastic piece 11 and the second elastic piece 12, and then arrives at the retaining position P. When the engaging protrusion 8 arrives at the retaining position P, the first elastic piece 11 and the second elastic piece 12 are restored, and the engaging protrusion 8 is retained at the retaining position P. The same applies when the engaging protrusion 8 arrives at the retaining position P from the rear.

The rear end part of the first elastic piece 11 is cantilever-supported by the base part 10, and the front end part of the second elastic piece 12 is cantilever-supported by the base part 10. Therefore, the first elastic piece 11 more easily bends than the second elastic piece 12 when further forward than the retaining position P. When the engaging protrusion 8 arrives at the retaining position P from the front, if the engaging protrusion 8 is disposed near the first elastic piece 11, the resistance when the engaging protrusion 8 passes between the first elastic piece 11 and the second elastic piece 12, and/or the force when the engaging protrusion 8 is retained at the retaining position P can be reduced. If the engaging protrusion 8 is disposed near the second elastic piece 12, the abovementioned resistance and/or the abovementioned force can be increased.

Furthermore, at a further rearward side than the retaining position P, the second elastic piece 12 bends more easily than the first elastic piece 11. When the engaging protrusion 8 arrives at the retaining position P from the rear, if the engaging protrusion 8 is disposed near the first elastic piece 11, the abovementioned resistance and/or the abovementioned force can be increased. If the engaging protrusion 8 is disposed near the second elastic piece 12, the abovementioned resistance and/or the abovementioned force can be reduced.

Moreover, if the engaging protrusion 8 is disposed at the center in the vertical direction between the first elastic piece 11 and the second elastic piece 12, the abovementioned resistance and/or force when the engaging protrusion 8 arrives at the retaining position P from the front, and the abovementioned resistance and/or force when the engaging protrusion 8 arrives at the retaining position from the rear can be made equivalent.

Furthermore, the engaging protrusion 8 can move in the vertical direction, and therefore even if the engaging protrusion 8 contacts the not easily bent first elastic piece 11 or second elastic piece 12, wear of these can be prevented. Furthermore, even if an attachment error is made with the receiving member 5 and engagement member 6, the attachment error of these can be absorbed.

Figure 8A:
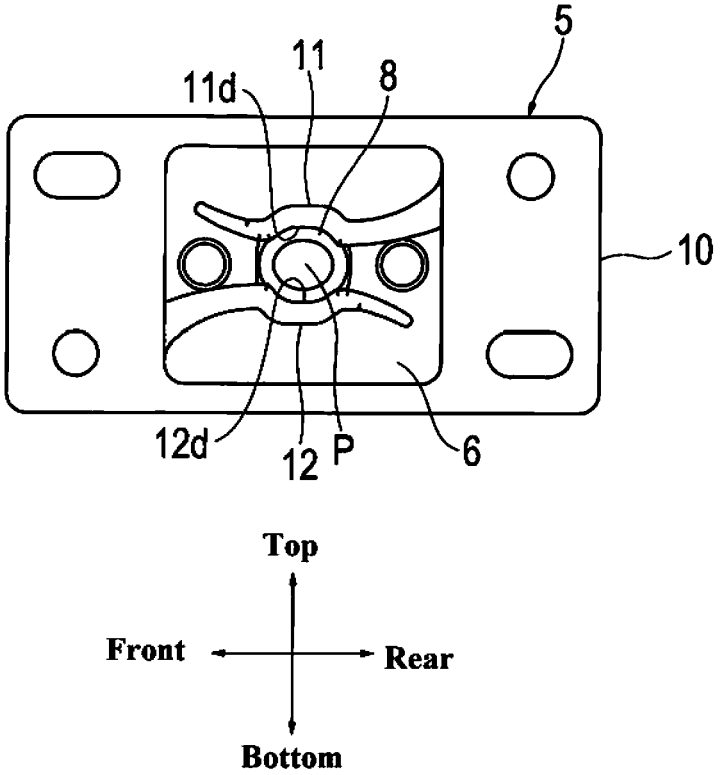
FIG. 8A-FIG. 8B are elevation view of the engagement member of the present embodiment (elevation view as viewed from the main body side.
Figure 8B:
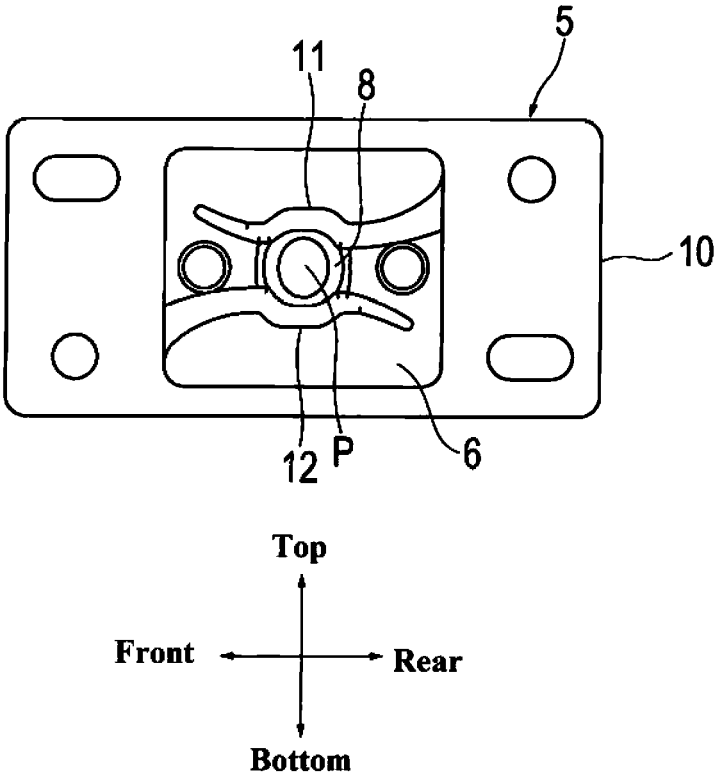

The vertical direction length of the engaging protrusion 8 can be changed by rotating the engaging protrusion 8 and inserting the rotated engaging protrusion 8 into the base part 7. As shown in FIG. 8A, if the vertical direction length of the engaging protrusion 8 is made short, the abovementioned resistance and/or force can be reduced, and as shown in FIG. 8B, if the vertical direction length of the engaging protrusion 8 is made long, the abovementioned resistance and/or force can be increased.

Modified Examples

Figure 9:
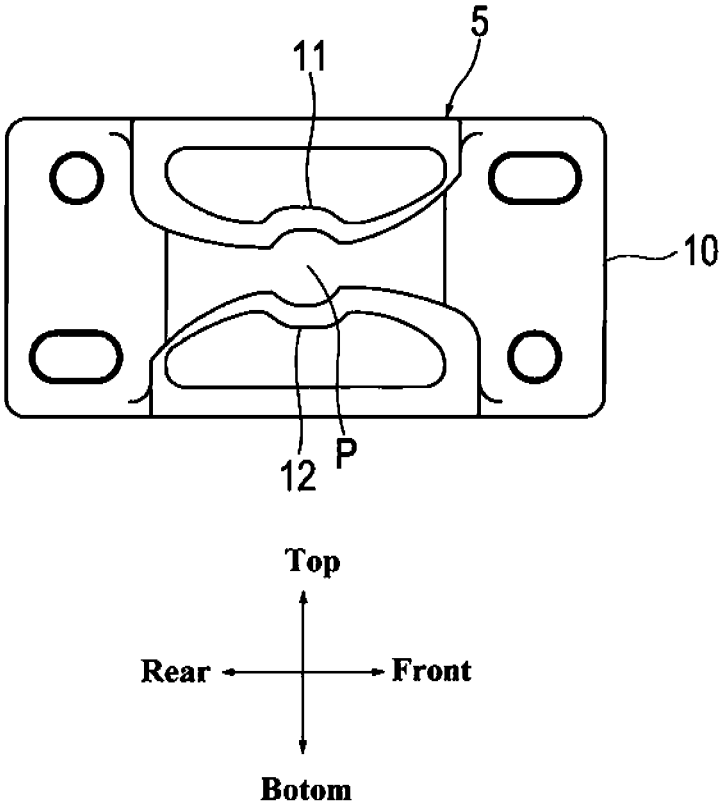
FIG. 9 is a back view of another example of the receiving member.

FIG. 9 illustrates another example of the receiving member 5. In the first embodiment, the first elastic piece 11 and the second elastic piece 12 are cantilever-supported by the base part 10, but in this example, the first elastic piece 11 and the second elastic piece 12 are supported at both ends by the base part 10. The rest of the configuration is the same as that of the receiving member 5 of the first embodiment, and therefore the same reference numerals are assigned, and descriptions thereof are omitted.

Figure 10:
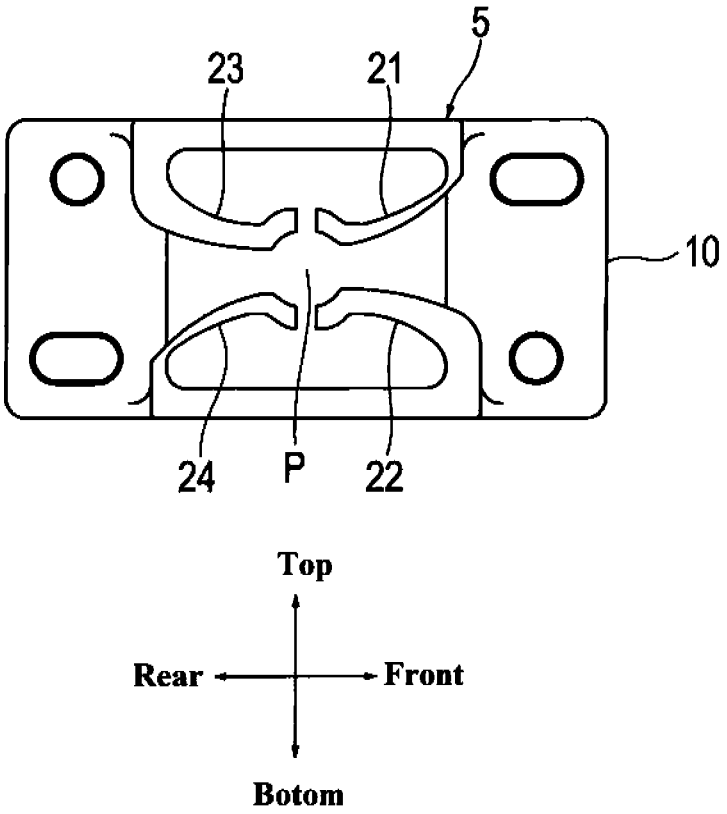
FIG. 10 is a back view of yet another example of the receiving member.

FIG. 10 illustrates yet another example of the receiving member 5. In the first embodiment, the receiving member 5 is provided with the first elastic piece 11 and the second elastic piece 12, but in this example, the receiving member 5 is provided with a first elastic piece 21 to a fourth elastic piece 24. The first elastic piece 21 to the fourth elastic piece 24 are cantilever-supported by the base part 10. The first elastic piece 21 is formed so as to bend more easily than the second elastic piece 22 at a further forward side than the retaining position P. In addition, the fourth elastic piece 24 is formed to as to bend more easily than the third elastic piece 23 at a further rearward side than the retaining position P.

Figure 11:
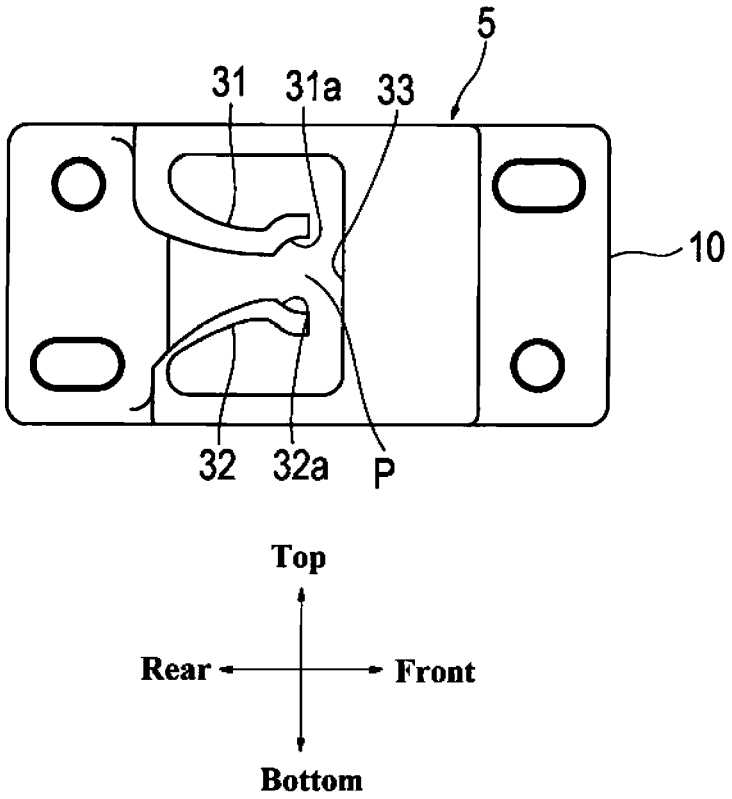
FIG. 11 is a back view of yet another example of the receiving member.
Figure 12:
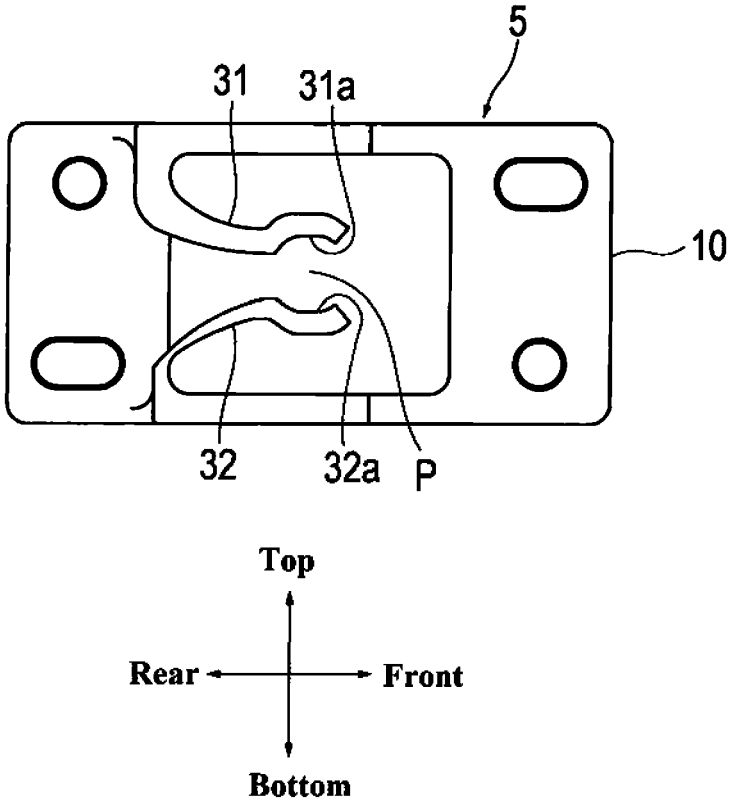
FIG. 12 is a back view of yet another example of the receiving member.

FIG. 11 and FIG. 12 illustrate yet other examples of the receiving member 5. In these examples, the receiving member 5 is provided with only a first elastic piece 31 and a second elastic piece 32. The first elastic piece 31 and the second elastic piece 32 are cantilever-supported by the base part 10. The engaging protrusion 8 is retained by free end parts 31*a*, 32*a* of the first elastic piece 31 and second elastic piece 32, and a stopper 33. As shown in FIG. 12, the free end parts 31*a*, 32*a* of the first elastic piece 31 and second elastic piece 32 are formed in a semicircle, and the engaging protrusion 8 can also be retained by only these free end parts. The second elastic piece 32 bends more easily than the first elastic piece 31 at a more forward side than the retaining position P. The receiving members 5 shown in FIG. 11 and FIG. 12 are used for pulling out the drawer 2 only to the rear side.

Figure 13A:
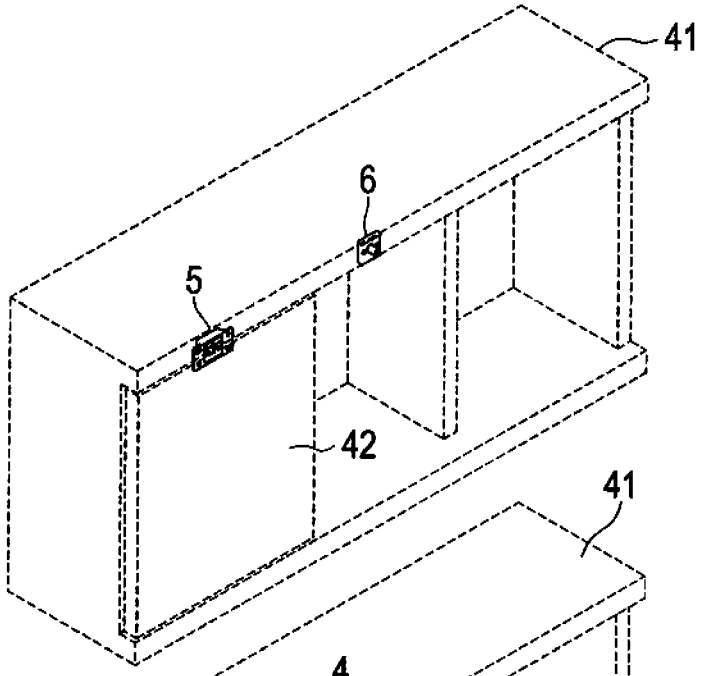
FIG. 13A-FIG. 13C are perspective view of a piece of furniture in which a retaining device of the present embodiment is incorporated
Figure 13B:
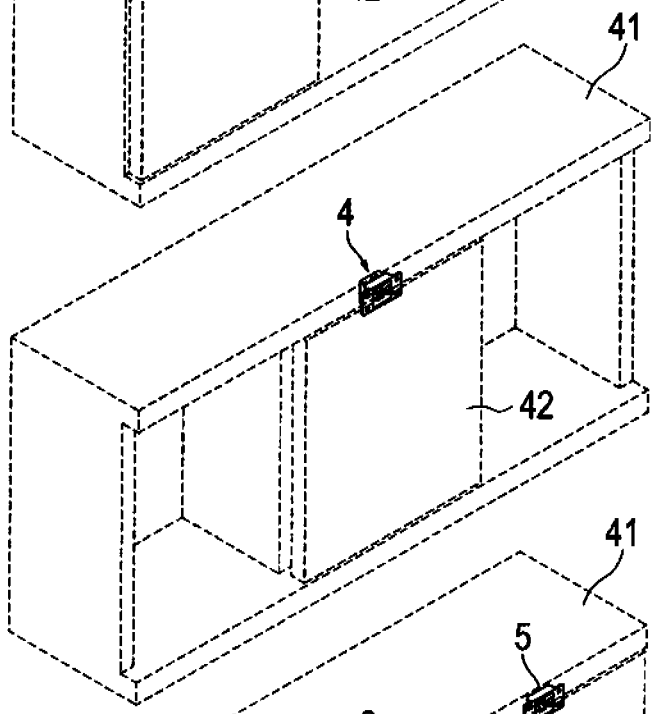
Figure 13C:
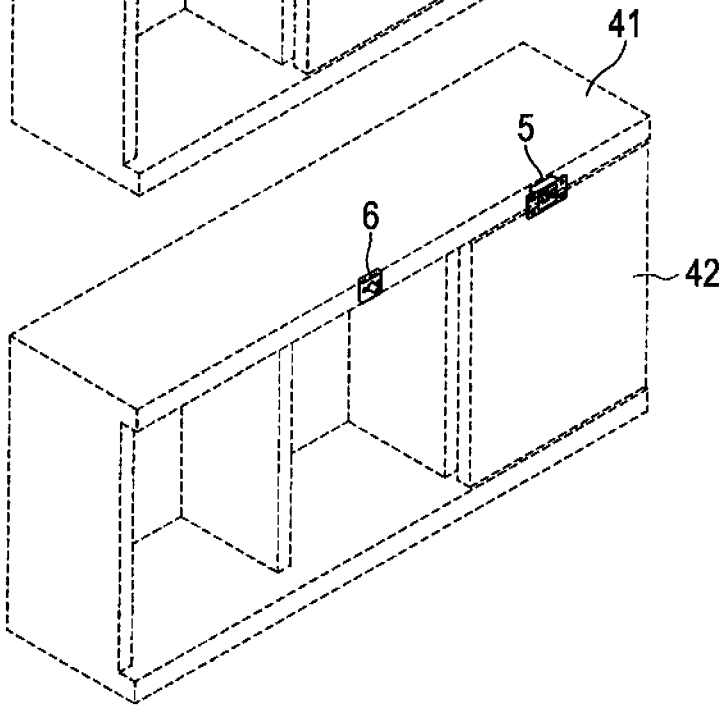

FIG. 13A-FIG. 13C illustrate an example in which the retaining device 4 of the first embodiment of the present invention is incorporated in a sliding door type piece of furniture. In this example, a sliding door 42 moves in the right and left directions with respect to a main body 41. FIG. 13A illustrates a left side closed position of the sliding door 42, FIG. 13B illustrates the center closed position of the sliding door 42, and FIG. 13C illustrates the right side closed position of the sliding door 42. In this example, the receiving member 5 is attached to the sliding door 42, and the engagement member 6 is attached to the main body main body 41.

Figures 14A, 14B, 14C:
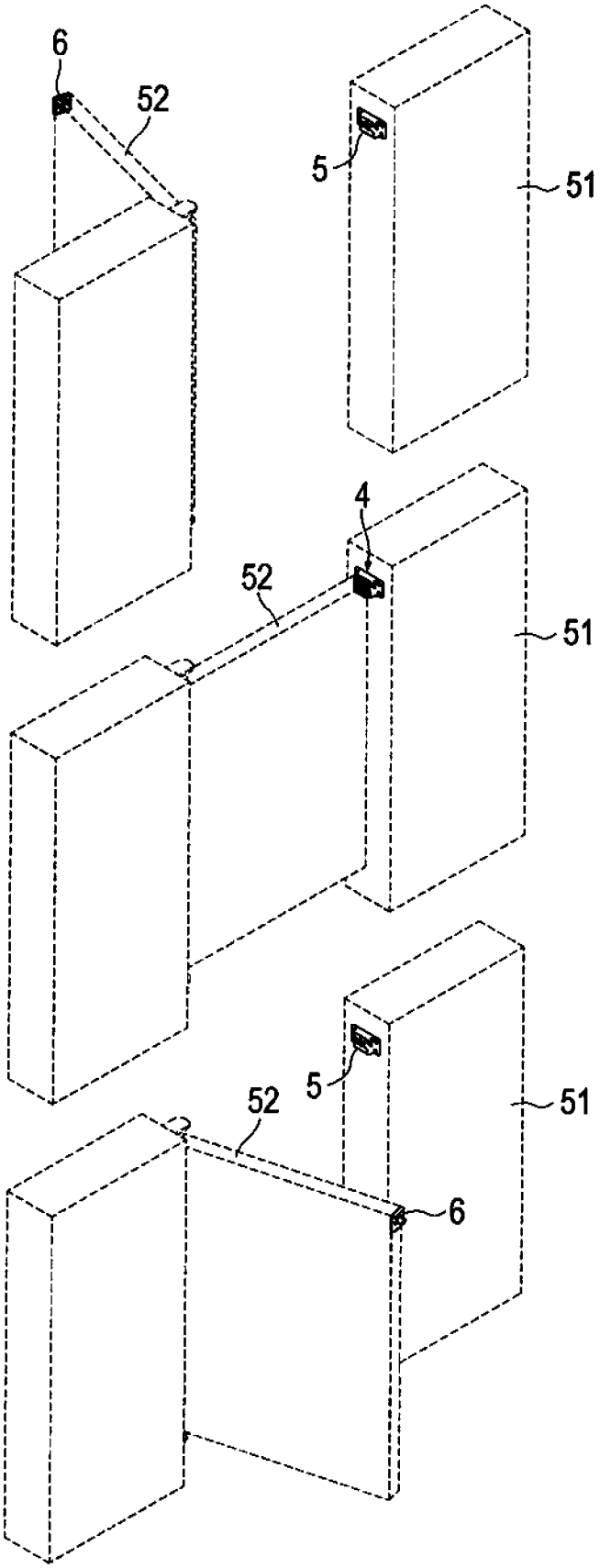
FIG. 14A-FIG. 14C are perspective view of a swing door in which the retaining device of the present embodiment is incorporated

FIG. 14A-FIG. 14C illustrate an example in which the retaining device 4 of the first embodiment of the present invention is incorporated in a swing door. In this example, a door 52 swings with respect to a main body 51. FIG. 14A illustrates the rear side opened position of the door 52, FIG. 14B illustrates the closed position of the door 52, and FIG. 14C illustrates the front side opened position of the door 52. In this example, the receiving member 5 is attached to the main body 51, and the engagement member 6 is attached to the door 52.

Note that the present invention is not limited to being embodied as described with the abovementioned embodiments, and can be embodied in various forms within a scope that does not depart from the gist of the present invention.

In the abovementioned embodiments, the retaining device and the slide rail are detached, but the retaining device can also be incorporated in the slide rail. In this case, for example, the main body is the outer rail, the movable body is the inner rail, the receiving member may be attached to either the outer rail or the inner rail, and the engagement member may be attached to the other. Likewise, the retaining device can also be incorporated in a closer or other pulling device of a sliding door. In this case, for example, the main body is the sliding door rail, the movable body is the pulling device, and the receiving member may be attached to either the sliding door rail or the pulling device, and the engagement member may be attached to the other.

In the abovementioned embodiment, the first elastic piece and the second elastic piece are cantilever-supported, and the thicknesses of these pieces are gradually made thinner from the fixed end towards the free end. However, the first elastic piece and the second elastic piece can also be configured with a uniform thickness from the fixed end towards the free end.

In the abovementioned embodiments, the drawer is configured so as to move from the closed position to the forward and rearward opened positions. However, the drawer may be configured so as to move from the closed position to only the forward opened position or only the rearward opened position.

REFERENCE NUMERALS

1 . . . main body
2 . . . drawer (movable body)

4 . . . retaining device
5 . . . receiving member
6 . . . engagement member
7 . . . base part of the engagement member
8 . . . engaging protrusion
10 . . . base part of the receiving member
11 . . . first elastic piece
11*a* . . . fixed end
11*b* . . . free end
11*d* . . . recess
11*f*, 11*e* . . . bending section
12 . . . second elastic piece
12 *a* . . . fixed end
12 *b* . . . free end
12*d* . . . recess
12*e*, 12*f* . . . bending section
21 . . . first elastic piece
22 . . . second elastic piece
31 . . . first elastic piece
32 . . . second elastic piece
41 . . . main body
42 . . . sliding door (movable body)
51 . . . main body
52 . . . door (movable body)
P . . . retaining position

What is claimed:

1. A retaining device comprising:

a receiving member attached to one of either a main body or a movable body; and an engagement member attached to the other of the main body or the movable body; wherein the receiving member comprises: a base part of the receiving member attached to the one; a first elastic piece supported by the base part of the receiving member; and a second elastic piece supported by the base part of the receiving member;

the engagement member is movable in both front and rear directions of the receiving member has an engaging protrusion that passes between the first elastic piece and the second elastic piece and is retained at a retaining position;

an interval between the first elastic piece and the second elastic piece at one side away from the retaining position in a relative movement direction of the engaging protrusion is narrower than the engaging protrusion; and at the one side away from the retaining position in the relative movement direction of the engaging protrusion, one of the first elastic piece and the second elastic piece bends more easily than the other;

wherein the engagement member comprises a base part of the engagement member attached to the other, and the engaging protrusion that is movable in a direction perpendicular to the relative movement direction with respect to the base part of the engagement member thereof, the engaging protrusion being a separate member.

2. The retaining device according to claim 1, wherein the first elastic piece and the second elastic piece are bent so that further to another side than the retaining position in the relative movement direction of the engaging protrusion, the interval between the first elastic piece and the second elastic piece becomes narrower than the engaging protrusion; and further to the other side than the retaining position in the relative movement direction of the engaging protrusion, one of the second elastic piece and the first elastic piece bends more easily than the other.

3. The retaining device according to claim 2, wherein at the other side, the first elastic piece is cantilever-supported by the base part of the receiving member;

and at the one side, the second elastic piece is cantilever-supported by the base part of the receiving member.

4. The retaining device according to claim 2, wherein the engagement member comprises a base part of the engagement member attached to the other, and the engaging protrusion that is movable in a direction perpendicular to the relative movement direction with respect to the base part of the engagement member thereof.

5. The retaining device according to claim 4, wherein the engagement member comprises the base part of the engagement member attached to the other, and the engaging protrusion that is detachably inserted into the base part of the engagement member; and the engaging protrusion comprises a long axis and a short axis, a length of the engaging protrusion in a direction perpendicular to the relative movement direction is varied between a length of the long axis and a length of the short axis by rotating the engaging protrusion with respect to the base part of the engagement member.

6. The retaining device according to claim 2, wherein the engagement member comprises the base part of the engagement member attached to the other, and the engaging protrusion that is detachably inserted into the base part of the engagement member; and the engaging protrusion comprises a long axis and a short axis, a length of the engaging protrusion in a direction perpendicular to the relative movement direction is varied between a length of the long axis and a length of the short axis by rotating the engaging protrusion with respect to the base part of the engagement member.

7. The retaining device according to claim 3, wherein the engagement member comprises a base part of the engagement member attached to the other, and the engaging protrusion that is movable in a direction perpendicular to the relative movement direction with respect to the base part of the engagement member thereof.

8. The retaining device according to claim 3, wherein the engagement member comprises the base part of the engagement member attached to the other, and the engaging protrusion that is detachably inserted into the base part of the engagement member; and the engaging protrusion comprises a long axis and a short axis, a length of the engaging protrusion in a direction perpendicular to the relative movement direction is varied between a length of the long axis and a length of the short axis by rotating the engaging protrusion with respect to the base part of the engagement member.

9. The retaining device according to claim 8, wherein the engagement member comprises a base part of the engagement member attached to the other, and the engaging protrusion that is movable in a direction perpendicular to the relative movement direction with respect to the base part of the engagement member thereof.

10. The retaining device according to claim 1, wherein the engagement member comprises the base part of the engagement member attached to the other, and the engaging protrusion that is detachably inserted into the base part of the engagement member; and the engaging protrusion comprises a long axis and a short axis, a length of the engaging protrusion in a direction perpendicular to the relative movement direction is varied between a length of the long axis and a length of the short axis by rotating the engaging protrusion with respect to the base part of the engagement member.

11. The retaining device according to claim 1, wherein the engagement member comprises the base part of the engagement member attached to the other, and the engaging protrusion that is detachably inserted into the base part of the engagement member; and the engaging protrusion comprises a long axis and a short axis, a length of the engaging protrusion in a direction perpendicular to the relative movement direction is varied between a length of the long axis and a length of the short axis by rotating the engaging protrusion with respect to the base part of the engagement member.

* * * * *